US008068749B2

(12) United States Patent
Mukai

(10) Patent No.: US 8,068,749 B2
(45) Date of Patent: Nov. 29, 2011

(54) FIXING APPARATUS AND IMAGE FORMING APPARATUS PROVIDED WITH FIXING APPARATUS

(75) Inventor: Takashi Mukai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 429 days.

(21) Appl. No.: 12/468,403

(22) Filed: May 19, 2009

(65) Prior Publication Data

US 2009/0290888 A1 Nov. 26, 2009

(30) Foreign Application Priority Data

May 20, 2008 (JP) ..... 2008-132328

(51) Int. Cl.
*G03G 15/20* (2006.01)

(52) U.S. Cl. ..... 399/33; 399/69; 399/122; 399/329

(58) Field of Classification Search ..... 399/33, 399/67–69, 122, 320, 328, 329; 219/216, 219/619

See application file for complete search history.

(56) References Cited

U.S. PATENT DOCUMENTS 7,684,746 B2 * 3/2010 Asakura et al. ..... 399/330
7,725,047 B2 * 5/2010 Maeda et al. ..... 399/69
2007/0212094 A1 9/2007 Asakura et al.

FOREIGN PATENT DOCUMENTS

JP 2005-292714 A 10/2005
JP 2007-241180 A 9/2007

* cited by examiner

*Primary Examiner* — Hoan Tran

(74) *Attorney, Agent, or Firm* — Birch, Stewart, Kolasch & Birch, LLP

(57) ABSTRACT

A fixing apparatus according to one embodiment of the present invention includes a rotating hot roller, a rotating pressure roller, a heating belt that contacts the hot roller and conducts heat, a first support roller and a second support roller that are heated by a heat source, support the heating belt suspended therebetween, and conduct heat to the heating belt, a first temperature detection device that detects a first temperature of an area of the first support roller where it contacts the heating belt or an area of the heating belt where it contacts the first support roller, a second temperature detection device that detects a second temperature of an area of the second support roller where it contacts the heating belt or an area of the heating belt where it contacts the second support roller, and a device for detecting rotation stoppage of one of the support rollers.

20 Claims, 7 Drawing Sheets

FIXING APPARATUS AND IMAGE FORMING APPARATUS PROVIDED WITH FIXING APPARATUS

This application claims priority under 35 U.S.C. §119(a) on Patent Application No. 2008-132328 filed in Japan on May 20, 2008, the entire contents of which are herein incorporated by reference.

BACKGROUND OF THE INVENTION

1. Field of the Invention

The present invention relates to fixing apparatuses used in image forming apparatuses and to image forming apparatuses provided with these fixing apparatuses.

2. Description of Related Art

In electrophotographic image forming apparatuses that are commonly employed in copiers, laser printers, and facsimile machines and the like, it has long been common for thermal fixing systems to be used as a fixing system used in fixing apparatuses, and hot roller fixing systems using a hot roller are ordinarily employed as the thermal fixing system. In these hot roller fixing systems, a hot roller that is internally provided with a heater of a heat source and whose outer circumference is covered with a rubber or a resin having excellent releasability and a pressure roller are caused to press against each other such that a transfer paper on which a toner image has been formed passes through a nip portion formed between these rollers, thereby thermally melting the toner, and fixing is carried out by causing the toner to fuse onto the transfer paper. These hot roller fixing systems are applied in high speed operations since the entire hot roller is maintained at a predetermined temperature.

However, in recent years, full color image forming apparatuses such laser printers and the like that support full color recording have become widely used, and toners of four colors of magenta, yellow, cyan, and black are used in these full color image forming apparatuses. Unlike a case of fixing a single color toner in which the toner is fixed by simply softening it while pressure is applied, to fix a full color toner image in a full color image forming apparatus, it is necessary to mix multiple types of color toners in a near-melted state, and therefore it is necessary for the fixing apparatus to put the toner into a completely melted state.

Thus, in the fixing apparatuses of hot roller fixing systems in full color image forming apparatuses, an elastic structure of a rubber layer formed by a silicone rubber or the like is provided on a support structure of a metal or the like having superior thermal conductivity, then a surface of the elastic structure is covered by a fluorocarbon resin having excellent releasability, thereby forming a hot roller.

However, even in fixing apparatuses of a hot roller fixing system using a hot roller such as this, when commencing operation of the image forming apparatus, it is necessary to heat the hot roller having a rubber layer of poor thermal conductivity using a heat source such as a heater provided inside the hot roller until the hot roller reaches a predetermined temperature. For this reason, time is required from powering up until operation is possible, which is a problem in that a waiting time is produced. Furthermore, there is a problem that the temperature of the hot roller drops during high speed continuous operations.

Accordingly, to address these problems in recent years, fixing apparatuses of a fixing system (belt-type external heating fixing system) have been proposed (see JP 2005-292714A and JP 2007-241180A for example) in which a heating belt of a belt-type external heating means provided with a heating belt, which rotates while being heated, is brought in contact with a surface of the hot roller, such that the hot roller is heated not only from the inside, but from the outside as well.

The invention described in JP 2005-292714A relates to a fixing apparatus of the above-mentioned belt-type external heating fixing system, in which in order to increase the amount of heat conducted to the hot roller from the belt-type external heating means, at least one heat source provided in the belt-type external heating means is arranged inside a contact region between the hot roller and the heating belt, and temperature drops of the heating belt are avoided by directly heating the heating belt using the heat source, such that the amount of heat conducted to the hot roller is increased and the temperature of the heat source is controlled using a temperature detection member.

The invention described in JP 2007-241180A relates to a fixing apparatus of the above-mentioned belt-type external heating fixing system, in which the amount of heat conducted to the hot roller is increased by causing the heating belt of a belt-type external heating means, which is provided with a heating belt, which is heated while rotating, to contact a surface of the hot roller, and the amount of conducted heat is controlled using a means capable of varying a contact surface area of the heating belt to the hot roller.

As described above, a fixing apparatus of the above-mentioned belt-type external heating fixing system is configured as shown in FIG. 7 for example. That is, the fixing apparatus of the belt-type external heating fixing system in FIG. 7 fixes unfixed images onto the recording material by causing the recording material to pass through a nip portion formed by contact between a rotating hot roller 90 and an unshown pressure roller.

In the fixing apparatus of this belt-type external heating fixing system, a heating belt 91 contacts and rotates against the hot roller 90. The heating belt 91 is suspended between and supported by support rollers 92 and 93, which are internally provided with heat sources 94 and 95. The support rollers 92 and 93 are heated by the heat sources 94 and 95, and heat is conducted from the thus-heated support rollers 92 and 93 to the heating belt 91.

The heat that is conducted to the heating belt 91 is further conducted from the heating belt 91 to the hot roller 90. Furthermore, in this fixing apparatus of the belt-type external heating fixing system, the support roller 92 and the support roller 93 contact the hot roller 90 through the heating belt 91. Furthermore, in this fixing apparatus of the belt-type external heating fixing system, in contrast to the internal heat sources provided inside the hot roller 90 for heating the hot roller 90, a portion constituted by the support rollers 92 and 93, the heat sources 94 and 95 provided inside the support rollers 92 and 93, and the heating belt 91 is referred to as an external heating member. It should be noted that the arrow shown in FIG. 7 indicates the rotation direction of the heating belt 91.

In this regard, the fixing apparatus of the belt-type external heating fixing system shown in FIG. 7 has problems such as the following. That is, due to thermal expansion of end portions of the support rollers 92 and 93, or thermal expansion or the like of shaft bearing portions, one of the support roller 92 and the support roller 93 may sometimes not rotate while the heating belt 91 is rotating. Specifically, there is a state such as the following when for example the support roller 92 is rotating and the support roller 93 is not rotating.

In FIG. 7, the support rollers 92 and 93 receive heat from the heat sources 94 and 95, and convey heat to the heating belt 91, and the continually rotating support roller 92 is capable of conveying heat from its entire surface to the heating belt 91. However, the support roller 93, which is not rotating, supplies heat only at an A region (FIG. 7) that contacts the heating belt 91, and a B region (FIG. 7) accumulates heat.

Since the support rollers 92 and 93 normally rotate together, heat that has accumulated in the heat sources 94 and 95 and heat that has accumulated in the support rollers 92 and 93 can be diffused by a post-rotation operation carried out in continuation from completion of the temperature raising operation after powering up or completion of a fixing operation. In this way, the external heating member can be prevented from rising in temperature abnormally after a rotation stoppage of the hot roller 90.

However, in a case where the support roller 93 is not rotating, since the support roller 93 is stopped in a state in which heat accumulated in the B region (FIG. 7) is not diffused, the external heating member rises in temperature abnormally. In this case, after the rotation stoppage of the support roller 93, the surface temperature of the hot roller 90 at a C portion, which is in contact with the not-rotating support roller 93, is higher compared to the surface temperatures of other portions of the hot roller 90.

The same is also conceivable in a case where the support roller 93 is rotating and the support roller 92 is not rotating, since it is merely that the conditions of the support roller 93 and the support roller 92 are opposite to the above.

Thus, in a case where a next fixing command is issued and a fixing operation is carried out in a state where temperature unevenness has been produced on the surface of the hot roller 90, a situation arises in which a problem is produced of uneven glossiness in the outputted image of the recording material that has undergone fixing. Further still, in a case where the temperature of the external heating member undesirably exceeds a heat-resistance temperature of the surface material of the hot roller 90, a situation arises in which problems are produced such as wrinkling in the surface of the hot roller 90.

Two support rollers, namely the support roller 92 and the support roller 93, are used in the above-described example, but the above-described problems still occur in a case where three or more support rollers are used.

SUMMARY OF THE INVENTION

Accordingly, the present invention has been devised in light of these circumstances, and it is an object thereof to provide a fixing apparatus of a belt-type external heating fixing system capable of detecting that rotation of any of a plurality of support rollers has stopped.

The present invention has been devised focusing on a point that when two support rollers are used as support rollers in a fixing apparatus of a belt-type external heating fixing system, the temperatures of the two support rollers are different when, as is described later, rotation of either one of the two support rollers has stopped.

Specifically, in a fixing apparatus according to the present invention, a recording material is caused to pass through a nip portion formed by contact between a rotating hot roller and a rotating pressure roller such that an unfixed image on the recording material becomes fixed.

In addition to the above-mentioned hot roller and pressure roller, this fixing apparatus is provided with the following components. First, it is provided with a heating belt that contacts and rotates with the hot roller and that conducts heat to the hot roller. Furthermore, it is provided with two or more support rollers that are provided with a heat source, are heated by the heat source, support the rotating heating belt suspended therebetween, and rotate to conduct heat to the heating belt. It should be noted that one of the two support rollers of the two or more above-mentioned support rollers is referred to as a first support roller and the other is referred to as a second support roller.

Also provided are a first temperature detection means that detects a first temperature, which is a temperature of an area of the first support roller where it contacts the heating belt or an area of the heating belt where it contacts the first support roller, and a second temperature detection means that detects a second temperature, which is a temperature of an area of the second support roller where it contacts the heating belt or an area of the heating belt where it contacts the second support roller. And a means for detecting rotation stoppage of one of the support rollers is provided, which detects a rotation stoppage of one of the support rollers, which is a rotation stoppage of one of the first support roller and the second support roller, by comparing the first temperature and the second temperature.

With the present invention, in a fixing apparatus of a belt-type external heating fixing system, in a first support roller, which is one of two support rollers among two or more support rollers, and a second support roller, which is the other support roller, rotation stoppage of one of the support rollers, which is a rotation stoppage of one of the first support roller and the second support roller, can be detected by comparing a first temperature, which is a temperature of a portion of the first support roller where the heating belt contacts the first support roller or a portion of the heating belt where the first support roller contacts the heating belt, and a second temperature, which is a temperature of a portion of the second support roller where the heating belt contacts the second support roller or a portion of the heating belt where the second support roller contacts the heating belt.

For this reason, when a rotation stoppage of one of the support rollers has been detected in the above-mentioned fixing apparatus, it is possible to carry out a measure against the rotation stoppage of one of the support rollers as is described later, and it is possible to prevent occurrences of problems that accompany a rotation stoppage of one of the support rollers.

In the above-mentioned fixing apparatus, the first support roller and the second support roller may contact the hot roller through the heating belt. By being configured in this manner, heat can be conducted with excellent efficiency from the first support roller and the second support roller to the hot roller through the heating belt.

Furthermore, in the above-mentioned fixing apparatus, as a technique for detecting rotation stoppage of one of the support rollers, the means for detecting rotation stoppage of one of the support rollers may be configured to carry out detection in a following manner for example in a case where a temperature of one of the first temperature and the second temperature is lower than a temperature of the other and the lower temperature is not greater than a predetermined value.

That is, it may be configured to detect that the second support roller is undergoing a rotation stoppage when the lower temperature is the first temperature and may detect that the first support roller is undergoing a rotation stoppage when the lower temperature is the second temperature. By being configured in this manner, a rotation stoppage of one of the support rollers can be reliably detected.

Furthermore, a means for storing information of rotation stoppage of one of the support rollers may be provided in the above-mentioned fixing apparatus. In this case, the means for storing information of rotation stoppage of one of the support rollers may be configured to store which of the first support roller and the second support roller is undergoing a rotation stoppage when the means for detecting rotation stoppage of one of the support rollers detects a rotation stoppage of one of the support rollers.

For this reason, maintenance personnel of the image forming apparatus in which the above-mentioned fixing apparatus is used can carry out measures against rotation stoppages of one of the support rollers by confirming information stored in the above-mentioned means for storing information of rotation stoppage of one of the support rollers.

Furthermore, a means for outputting warning information of rotation stoppage of one of the support rollers may be provided in the above-mentioned fixing apparatus. In this case, the means for outputting warning information of rotation stoppage of one of the support rollers is configured to output warning information of which of the first support roller and the second support roller is undergoing a rotation stoppage when the means for detecting rotation stoppage of one of the support rollers detects a rotation stoppage of one of the support rollers.

By being configured in this manner, an operator or the like of the image forming apparatus in which the above-mentioned fixing apparatus is used can be prompted to urgently carry out measures against rotation stoppages of one of the support rollers.

Furthermore, the above-mentioned fixing apparatus may be provided with a contact adjustment means that carries out contact adjustment in which either the first support roller, the second support roller, or both are moved apart from or brought closer to the hot roller. In this case, the contact adjustment means is configured to carry out the contact adjustment when the means for detecting rotation stoppage of one of the support rollers detects a rotation stoppage of one of the support rollers.

Alternately, it may be provided with a contact pressure adjustment means that adjusts a contact pressure of either the first support roller, the second support roller, or both to the hot roller. In this case, the contact pressure adjustment means is configured to adjust the contact pressure when the means for detecting rotation stoppage of one of the support rollers detects a rotation stoppage of one of the support rollers.

By being configured in this manner, rotation of the first support roller or the second support roller undergoing a rotation stoppage can be prompted automatically.

Furthermore, the above-mentioned fixing apparatus may be provided with a support roller heat source power supply means that supplies power to the heat source provided in the first support roller and the second support roller. In this case, the support roller heat source power supply means is configured to reduce the power supplied to the heat source provided in either of the first support roller or the second support roller that is undergoing a rotation stoppage when the means for detecting rotation stoppage of one of the support rollers detects a rotation stoppage of one of the support rollers.

By being configured in this manner, it is possible to prevent abnormal temperature rises of the support rollers and the heating belt.

Furthermore, the above-mentioned fixing apparatus may be provided with a support roller heat source power supply means that supplies power to the heat source provided in the first support roller and the second support roller, and may be provided with a hot roller control means such as the following.

The hot roller control means is configured that, after a fixing command has been received and the hot roller is rotated, and the recording material is caused to pass through the nip portion to complete a fixing operation, stops rotation of the hot roller after the support roller heat source power supply means stops a power supply and post-rotation has been carried out in which the hot roller is caused to rotate for a prescribed time.

In this case, the hot roller control means is configured so as to set a time of the post-rotation longer than the prescribed time when the means for detecting rotation stoppage of one of the support rollers detects a rotation stoppage of one of the support rollers.

By being configured in this manner, the heat of the support rollers and the heating belt can be sufficiently dispersed, and it is possible to prevent abnormal temperature rises of the support rollers and the heating belt.

Furthermore, an image forming apparatus according to the present invention is provided with a fixing apparatus according to the present invention as described above. The image forming apparatus is provided with the effects that are provided by the above-described fixing apparatus.

DESCRIPTION OF PREFERRED EMBODIMENTS

Next, description is given regarding a fixing apparatus according to an embodiment of the present invention. First, description is given regarding tests using a fixing apparatus 6 shown in FIG. 4, then description is given regarding a fixing apparatus according to an embodiment of the present invention with reference to the accompanying diagrams with respect to an example of an image forming apparatus in which the fixing apparatus 6 is used as a fixing portion.

Figure 4:
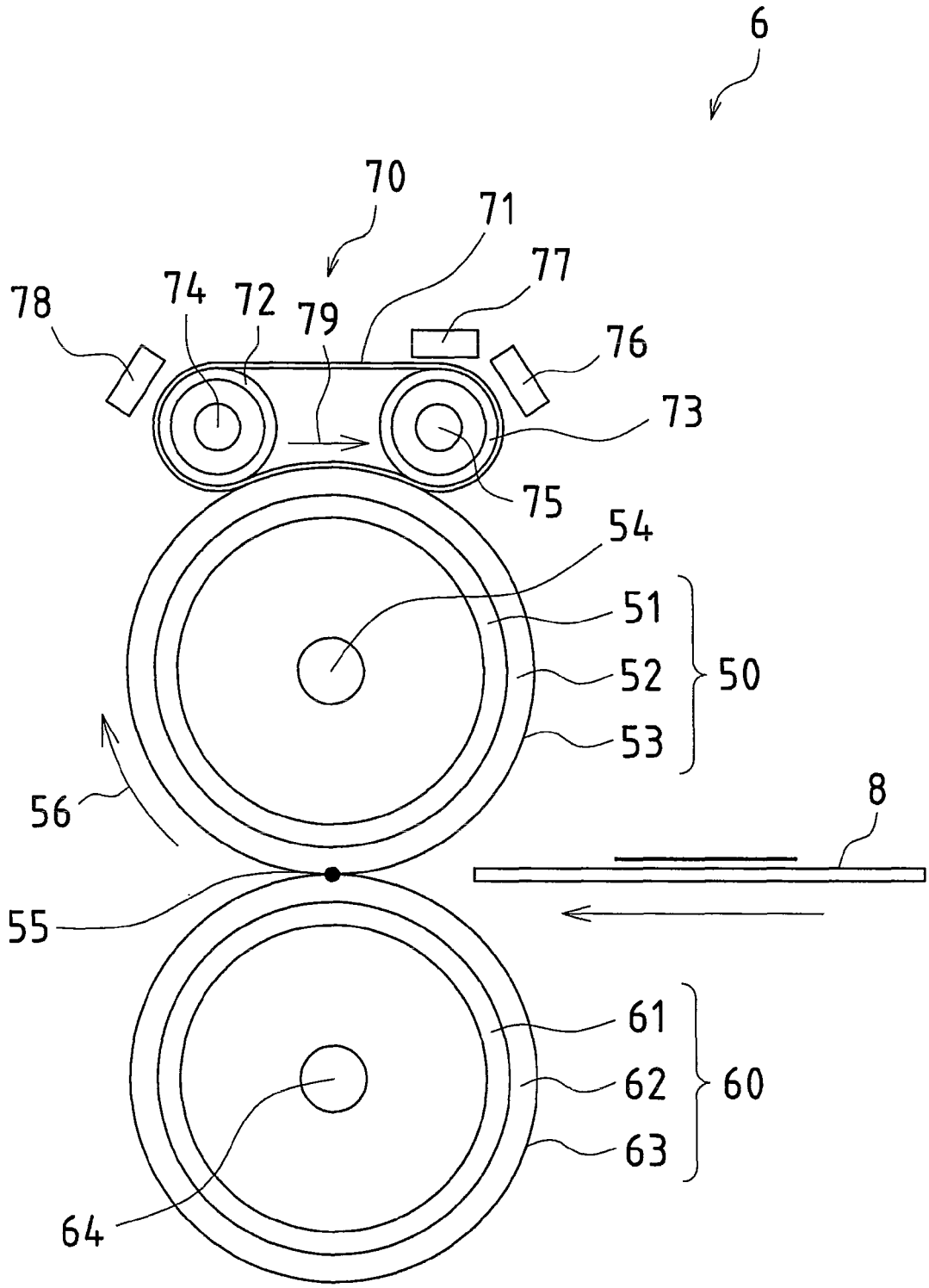
FIG. 4 is a schematic view showing a configuration of a fixing apparatus according to one embodiment of the present invention.

First, description is given regarding tests using the fixing apparatus 6 shown in FIG. 4. In the fixing apparatus 6 shown in FIG. 4, a recording material 8 is caused to pass through a nip portion 55 formed by a fixing roller (corresponding to the aforementioned hot roller) 50 that rotates and a rotating pressure roller 60 such that an unfixed image on the recording material 8 becomes fixed.

In the above-mentioned fixing apparatus 6, an endless belt (corresponding to the aforementioned heating belt) 71 contacts and rotates on a top portion of the fixing roller 50 that rotates. The endless belt 71 is suspended between and supported by two support rollers, namely a first support roller 72 internally provided with a heat source 74 and a second support roller 73, which similarly is internally provided with a heat source 75.

The first support roller 72 and the second support roller 73 are heated by the heat sources 74 and 75, and heat is conducted from the thus-heated first support roller 72 and second support roller 73 to the endless belt 71.

In the fixing apparatus 6, the heat that is conducted to the endless belt 71 is further conducted from the endless belt 71 to the fixing roller 50. Furthermore, in the fixing apparatus 6, the first support roller 72 and the second support roller 73 contact the fixing roller 50 through the endless belt 71.

Furthermore, a thermistor 78 is arranged for the first support roller 72 of the fixing apparatus 6 near an area of the endless belt 71 that contacts a vicinity of an area on an approximately opposite side from an area where the first support roller 72 contacts the fixing roller 50 through the endless belt 71. Similarly, a thermistor 76 is arranged for the second support roller 73 near an area of the endless belt 71 that contacts a vicinity of an area on an approximately opposite side from an area where the second support roller 73 contacts the fixing roller 50 through the endless belt 71.

The thermistor 78 is used for detecting a first temperature, which is a temperature of an area of the endless belt 71 where the endless belt 71 contacts the first support roller 72. Furthermore, the thermistor 76 is used for detecting a second temperature, which is a temperature of an area of the endless belt 71 where the endless belt 71 contacts the second support roller 73.

Furthermore, in the fixing apparatus 6, an area constituted by the first support roller 72 and the second support roller 73, the heat source 74 and heat source 75 provided inside the first support roller 72 and the second support roller 73, and the endless belt 71 is referred to as an external heating member 70. It should be noted that an arrow 56 in FIG. 4 indicates a rotation direction of the fixing roller 50 and an arrow 79 indicates a rotation direction of the endless belt 71.

With the above-described fixing apparatus 6, a test was carried out of performing a temperature raising operation after powering up in which the fixing roller 50 was caused to rotate, and the endless belt 71 and the second support roller 73 were set to rotate along with the rotation of the fixing roller 50, but the first support roller 72 was set to not rotate.

Figure 5:
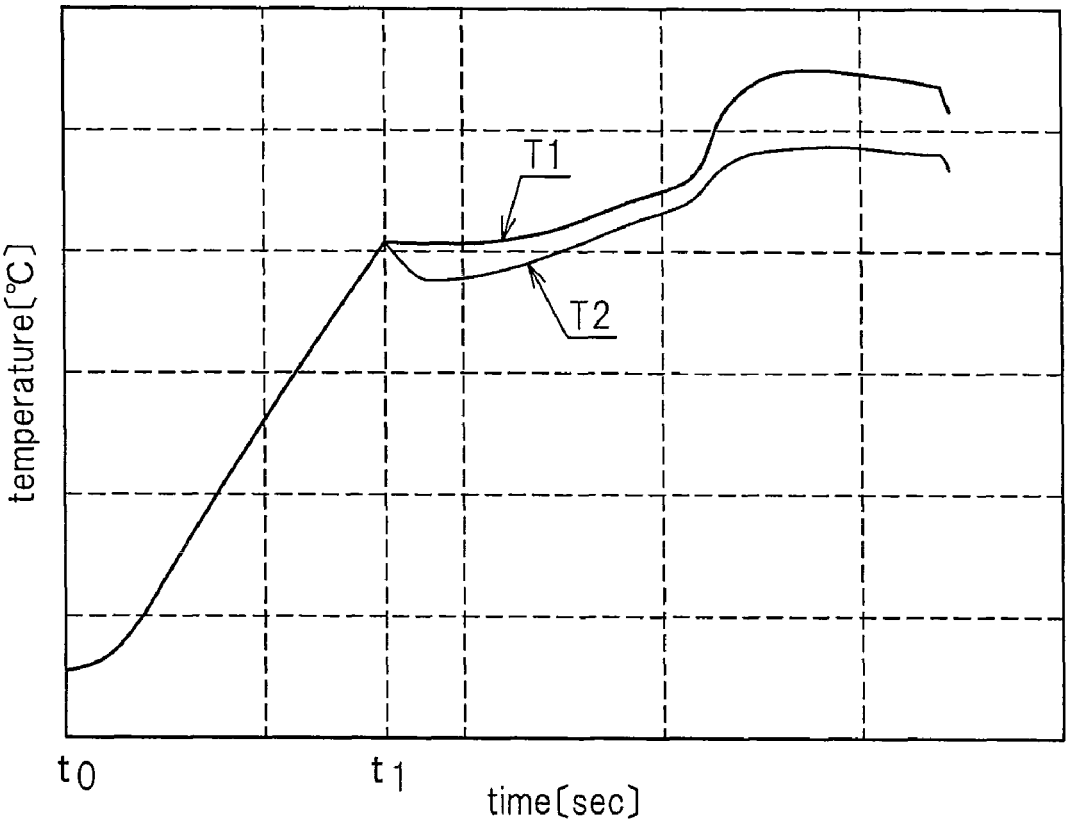
FIG. 5 is a graph showing a result of a test according to one embodiment of the present invention.

FIG. 5 is a graph showing a condition of temperature raising during a temperature raising operation after powering up in a test of the fixing apparatus 6. In FIG. 5, t0 indicates a time point of powering up, and t1 indicates a rotation commencement time point of the fixing roller 50. Furthermore, T1 indicates the above-mentioned first temperature and T2 indicates the above-mentioned second temperature.

FIG. 5 shows a state in which the first support roller 72 is not rotating from the powering up time point t0, but the second support roller 73 is rotating. In this state it is understood that from t1 onward, the second temperature T2 greatly drops compared to the first temperature T1.

This is a phenomenon that occurs because the first support roller 72, since it is not rotating, cannot supply sufficient heat to the endless belt 71, and the endless belt 71 undesirably captures an above-normal amount of heat from the second support roller 73.

That is, when the first support roller 72 is not rotating, the supply of heat to the endless belt 71 is carried out from only a portion of the surface of the first support roller 72. For this reason, the amount of heat supplied to the endless belt 71 is less than normal. Accordingly, the endless belt 71 captures an above-normal amount of heat from the second support roller 73, which can supply heat from its entire roller surface, and therefore temperature detection results of the second support roller 73, which is the support roller that is rotating, become undesirably lower.

The following is understood from the above-described testing of the fixing apparatus 6. That is, first, the first temperature, which is the temperature of an area of the endless belt 71 where the endless belt 71 contacts the first support roller 72, and the second temperature, which is the temperature of an area of the endless belt 71 where the endless belt 71 contacts the second support roller 73, are measured. Then, the thus-measured first temperature and second temperature are compared.

In comparing the first temperature and the second temperature, in a case where the lower of these temperatures is a prescribed value or lower, it can be determined that the second support roller is undergoing a rotation stoppage when the lower temperature is the first temperature, and it can be determined that the first support roller is undergoing a rotation stoppage when the lower temperature is the second temperature. That is, it is possible to detect a rotation stoppage of one of the support rollers, which is a rotation stoppage of one of the first support roller 72 and the second support roller 73. The above-mentioned prescribed value can be obtained from test results using statistical processing.

Accordingly, a configuration in which a fixing apparatus is provided with a function that detects a rotation stoppage of one of the support rollers is the fixing apparatus 6 according to the present embodiment.

Next, with reference to the accompanying diagrams, description is given regarding an example of an image forming apparatus 1 that uses the fixing apparatus 6 as a fixing portion as a description of the fixing apparatus according to the present embodiment. It should be noted that hereinafter the fixing apparatus 6 is referred to as a fixing portion 6.

Figure 1:
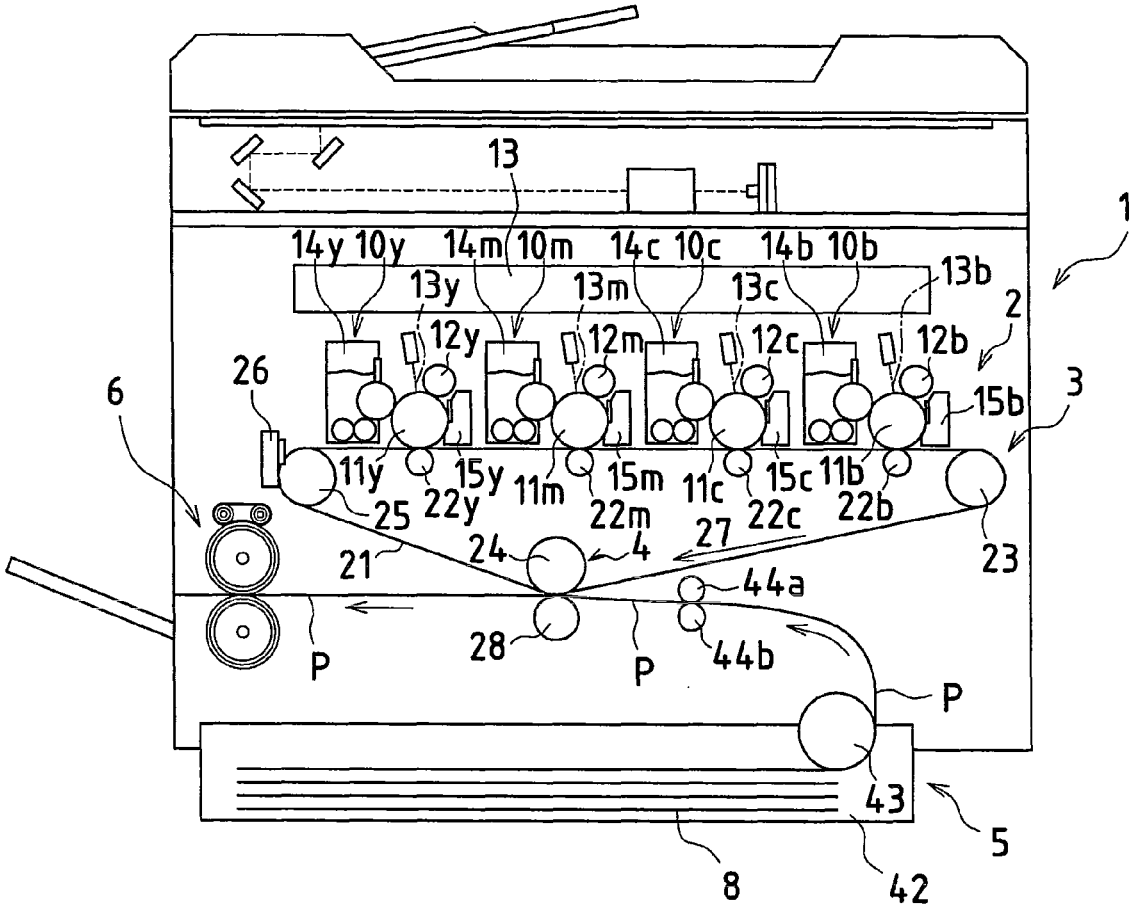
FIG. 1 is a schematic view showing a configuration of an image forming apparatus using a fixing apparatus according to one embodiment of the present invention as a fixing portion.

FIG. 1 is a schematic view showing a configuration of the image forming apparatus 1. In FIG. 1, the image forming apparatus 1 is constituted by an image forming portion 2, an intermediate transfer portion 3, a secondary transfer portion 4, the fixing portion 6, and a recording medium supply portion 5.

Figure 2:
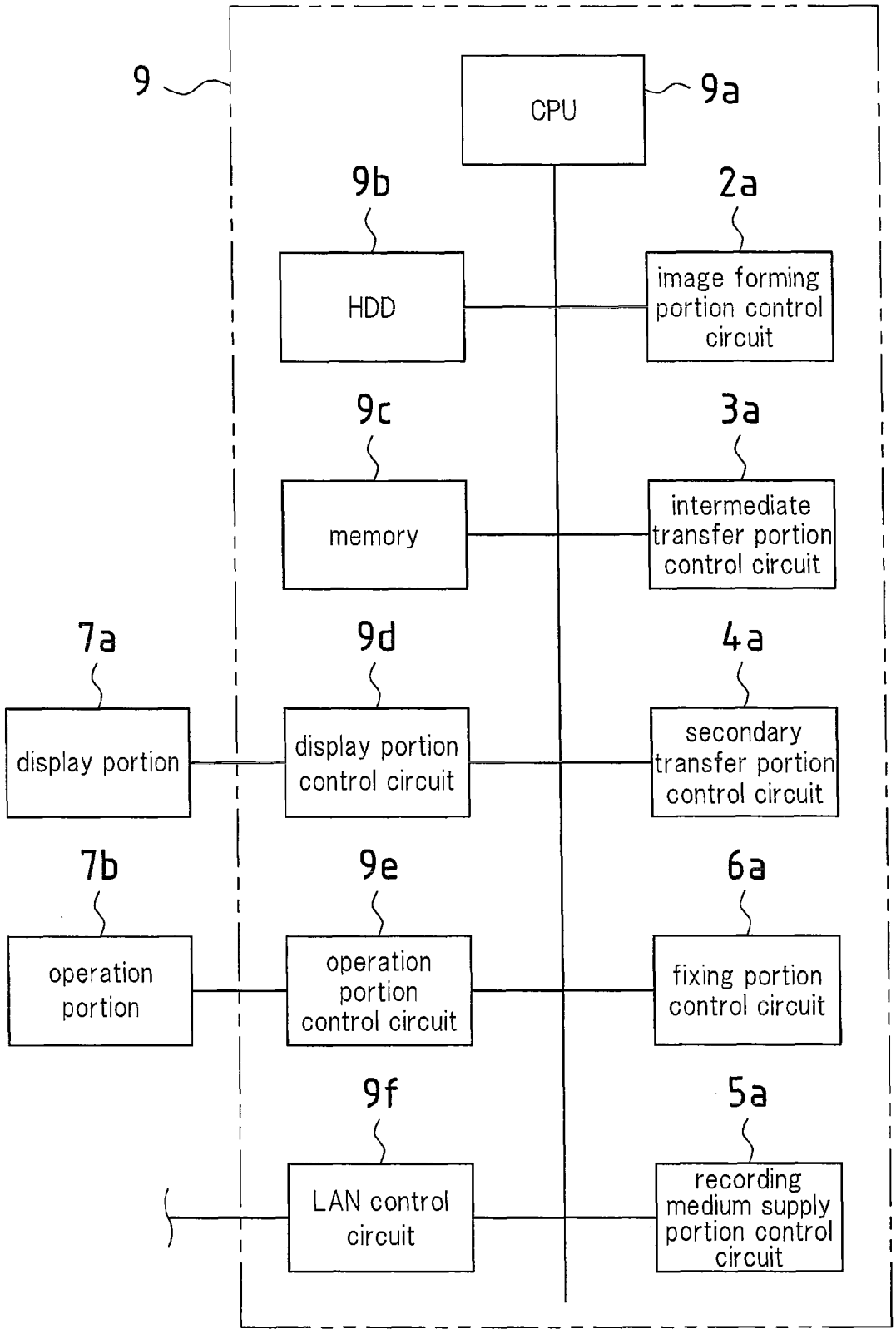
FIG. 2 is a block diagram showing a configuration of control unit of the image forming apparatus shown in FIG. 1.

In addition to the above-mentioned portions, the image forming apparatus 1 is provided with a display portion 7*a*, which is formed by an LCD, an operation portion 7*b* provided with various keys, and a control unit 9 that controls the above-mentioned portions and the like. FIG. 2 is a block diagram showing a configuration of the control unit 9.

In FIG. 2, the control unit 9 is constituted by a CPU 9*a*, a HDD 9*b*, a memory 9*c*, a display portion control circuit 9*d*, an operation portion control circuit 9*e*, a LAN control circuit 9*f*, an image forming portion control circuit 2*a*, an intermediate transfer portion control circuit 3*a*, a secondary transfer portion control circuit 4*a*, a fixing portion control circuit 6*a*, and a recording medium supply portion control circuit 5*a*.

The CPU 9*a* is constituted by a microprocessor, and software such as an OS and various control programs and application programs used in controlling the image forming apparatus 1 is loaded into the HDD 9*b* such that the CPU 9*a* carries out various controls and processing based on these forms of software.

Furthermore, the display portion control circuit 9*d* is used in carrying out control of the display portion 7*a*, as is the operation portion control circuit 9*e* for operation portion 7*b*, the LAN control circuit 9*f* for a LAN interface, the image forming portion control circuit 2*a* for the image forming portion 2, the intermediate transfer portion control circuit 3*a* for the intermediate transfer portion 3, the secondary transfer portion control circuit 4*a* for the secondary transfer portion 4, the fixing portion control circuit 6*a* for the fixing apparatus 6, and the recording medium supply portion control circuit 5*a* for the recording medium supply portion 5.

Hereinafter, description is given regarding the above-mentioned portions. First, description is given regarding the recording medium supply portion 5. The recording medium supply portion 5 is constituted by a recording paper housing tray 42 that houses recording paper 8, which are a recording material, a recording paper carry-out roller 43, which is provided for the recording paper housing tray 42 and carries out the recording paper 8 that are housed in the recording paper housing tray 42, transport rollers 44*a* and 44*b*, which transport the recording paper 8 that have been carried out to secondary transfer portion 4, and a transport path P.

Next, description is given regarding the image forming portion 2. As shown in FIG. 1, the image forming portion 2 includes image forming units 10*y*, 10*m*, 10*c*, and 10*b*, and these form electrostatic latent images corresponding to digital signals of each hue (hereinafter referred to as image information), then develop the electrostatic latent images and form an image that is formed by toner of each color. That is, the image forming unit 10*y* forms a toner image corresponding to yellow color image information, the image forming unit 10*m* forms a toner image corresponding to magenta color image information, the image forming unit 10*c* forms a toner image corresponding to cyan color image information, and the image forming unit 10*b* forms a toner image corresponding to black color image information.

Apart from that the image forming units 10*y*, 10*m*, 10*c*, and 10*b* use yellow color developer, magenta color developer, cyan color developer, and black color developer respectively, and that of the image information inputted to the image forming portion 2, these units receive pixel signals corresponding to a yellow color component image, pixel signals corresponding to a magenta color component image, pixel signals corresponding to a cyan color component image, and pixel signals corresponding to a black color component image respectively, the configurations of these units are the same, and therefore hereinafter the image forming unit 10*y* corresponding to yellow color is indicated as a representative example, and description regarding the other colors is omitted.

It should be noted that when individually indicating an image forming unit 10 or the like corresponding to each color, this is represented by adding an additional alphabetic letter, namely y (yellow color), m (magenta color), c (cyan color), or b (black color). The image forming units 10*y*, 10*m*, 10*c*, and 10*b* are arrayed lined up in this order in a row in a movement direction (sub-scanning direction) of an intermediate transfer belt 21, which is an intermediate transfer medium, that is, they are lined up from an upstream side of the arrow 27 direction to a downstream side.

Figure 3:
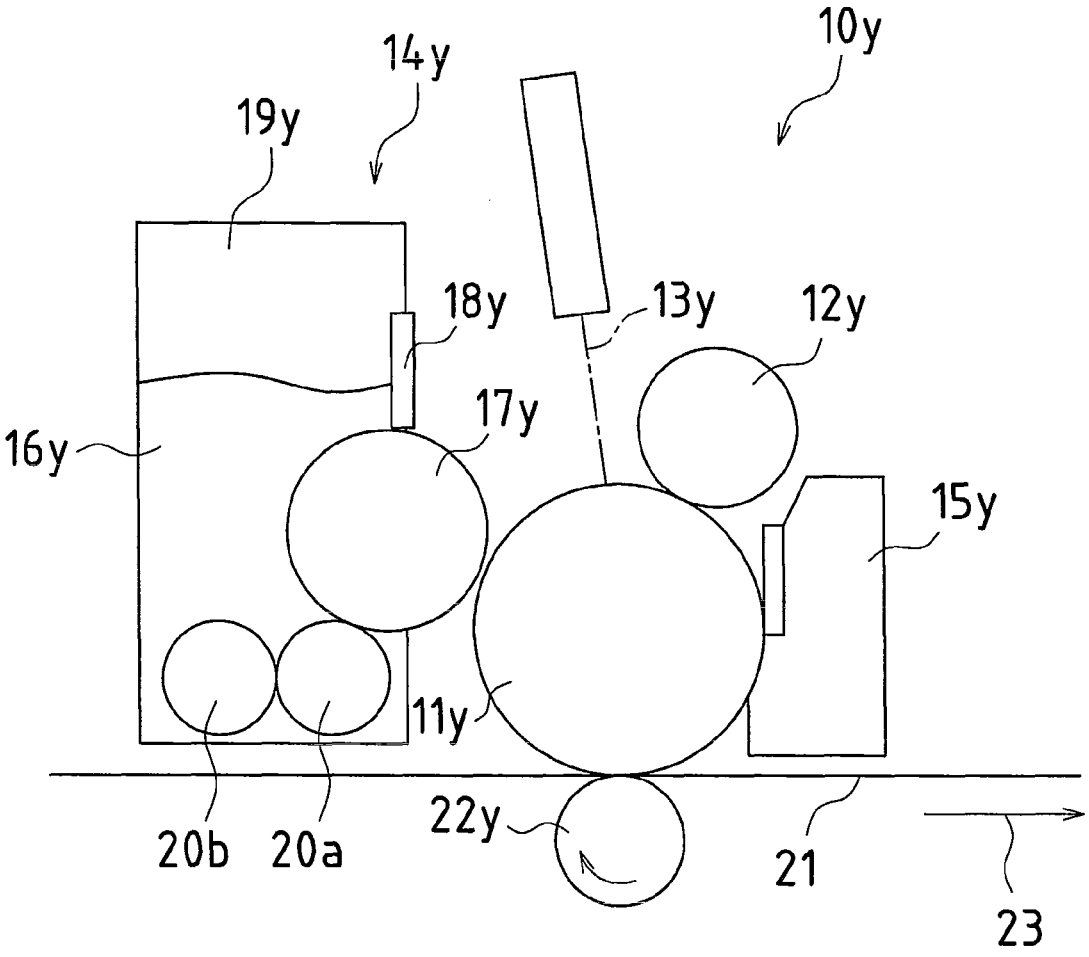
FIG. 3 is a schematic view showing a configuration of an image forming unit in the image forming apparatus shown in FIG. 1.

As shown in FIG. 3, the image forming unit 10*y*, is constituted including a photosensitive drum 11*y*, on whose surface a yellow color toner image is to be formed, a charging roller 12*y* that uniformly charges the surface of the photosensitive drum 11*y*, an optical scanning unit 13 that forms an electrostatic latent image by exposing light in response to image information onto the charged surface of the photosensitive drum 11*y*, a development device 14*y* that forms a toner image by causing toner to adhere to the electrostatic latent image that has been formed on the surface of the photosensitive drum 11*y*, and a drum cleaner 15*y* that removes and collects toner that has not undergone intermediate transfer onto the intermediate transfer belt 21 and is residual on the surface of the photosensitive drum 11*y*. It should be noted that FIG. 3 is a schematic view that shows a configuration of the image forming unit 10*y*.

The photosensitive drum 11*y* is a latent image carrier on whose surface an electrostatic latent image is formed by exposing a light in response to image information, and is disposed so as to be readily rotatable. The photosensitive drum 11*y* is supported so as to be capable of being rotationally driven around its axis by an unshown drive means, and is configured including an unshown conductive substrate of a cylinder shape, a columnar shape, or a thin film sheet shape (preferably a cylinder shape) and a photosensitive layer formed on a surface of the conductive substrate.

An ordinary component used in this field may be used for the photosensitive drum 11*y*, an example of which is a photosensitive drum 11*y* that includes an aluminum-based tube, which is a conductive substrate, and an organic photosensitive layer, which is a photosensitive layer formed on the surface of the aluminum-based tube, and that is connected to a GND (ground) electric potential.

The organic photosensitive layer may be formed by laminating a charge generating layer including a charge generating substance, and a charge conveying layer including a charge conveying substance, and may be a single layer that includes a charge generating substance and a charge conveying substance. Although there is no particular limitation to the layer thickness of the organic photosensitive layer, it may be 20 μm for example. Furthermore, an underlayer may be provided between the organic photosensitive layer and the conductive substrate. Further still, a protective layer may be provided on a surface of the organic photosensitive layer.

The photosensitive drum 11*y* is rotationally driven in a counterclockwise direction facing the intermediate transfer belt 21 in FIG. 3 at a peripheral velocity of 220 mm/s for example. The drive means of the photosensitive drum 11*y* is controlled by an unshown control means, which controls the rotation velocity of the photosensitive drum 11*y*.

The charging roller 12*y* is a charging means that charges the surface of the photosensitive drum 11*y* to an electric potential of a predetermined polarity. There is no limitation to the charging roller 12*y* as the charging means, and instead of the charging roller 12*y*, it is possible to use a brush-type charging unit, a charger-type charging unit, or a corona charging unit referred to as a scorotron.

The optical scanning unit 13 is a latent image forming means, which irradiates a laser light 13*y* corresponding to yellow color image information onto the surface of the photosensitive drum 11*y*, which is in a charged state, to form an electrostatic latent image on the surface of the photosensitive drum 11*y* corresponding to the yellow color image information. A semiconductor laser device or the like may be used as a light source of the laser light.

The development device 14*y* is a development means arranged facing the photosensitive drum 11*y*. It carries the yellow color developer 16*y*, which includes yellow color toner and carrier, on a surface of a development sleeve 17*y* and transports it to the surface of the photosensitive drum 11*y*, thereby developing the electrostatic latent image that is formed on the surface of the photosensitive drum 11*y* and making it a visible image. It should be noted that a development device that employs a one-constituent developer not containing carrier may also be used as the development device 14*y*. Furthermore, the developer 16*y* contained in a development tank 19*y* in the development device 14*y* is churned and transported by churning transport members 20*a* and 20*b* and adheres to the surface of the development sleeve 17*y*. And a layer thickness of the developer adhering to the surface of the development sleeve 17*y* is regulated to a prescribed thickness by a developer regulating member 18*y*.

The development sleeve 17*y* is rotationally driven in a same direction as the rotational drive direction of the photosensitive drum 11*y* at a development nip area in close vicinity to the photosensitive drum 11*y*. Accordingly, the rotational drive direction around its axis is a reverse direction.

The drum cleaner 15*y* removes and collects yellow color toner that is residual on the surface of the photosensitive drum 11*y* after the yellow color toner image on the surface of the photosensitive drum 11*y* has undergone intermediate transfer to the intermediate transfer belt 21.

Hereinafter, detailed description is given regarding constituents of the developers 16*y*, 16*m*, 16*c*, and 16*b* used in the image forming apparatus 1 of the present embodiment.

The toner contains a binder resin, a coloring agent, and a release agent. An ordinary substance used in this field may be used for the binder resin, examples of which include polystyrene, a styrene substitute homopolymer, a styrene-based copolymer, polyvinyl chloride, polyvinyl acetate, polyethylene, polypropylene, polyester, and polyurethane. One type of binder resin may be used independently and it is also possible to use a combination of two or more types of binder resin.

Among these binder resins, and in terms of such factors as preservative properties and durability as a color toner, a binder resin having a softening point of 100° C. to 150° C. and a glass transition point of 50° C. to 80° C. is preferable, and a polyester having the above-described softening point and glass transition point is particularly preferable. Polyester shows a high degree of transparency in a softened or melted state. In a case where the binder resin is polyester, when a multicolor toner image, in which toner images of yellow, magenta, cyan, and black are superimposed on each other, is fixed to the recording paper 8, the polyester itself becomes transparent, and therefore a sufficient color production can be obtained by subtractive color mixing.

Toner pigments and dyes conventionally used in electrophotographic image forming techniques may be used as the coloring agent. Examples of pigments include azo-based pigments, benzimidazolone-based pigments, quinacridone-based pigments, phthalocyanine-based pigments, isoindolinone-based pigments, isoindoline-based pigments, dioxazine-based pigments, anthraquinone-based pigments, perylene-based pigments, perinone-based pigments, thioindigo-based pigments, quinophthalone-based pigments, organic-based pigments such metal complex-based pigments or the like, carbon black, titanium oxide, molybdenum red, chrome yellow, titan yellow, chrome oxide, and inorganic-based pigments such as Berlin blue or the like, and metal powders or the like such as aluminum powder or the like. One type of pigment may be used independently and it is also possible to use a combination of two or more types of pigment.

Wax may be used as the release agent for example. An ordinary substance used in this field may be used as the wax, examples of which are a polyethylene wax, a polypropylene wax, and a paraffin wax. In addition to a binder resin, a coloring agent, and a release agent, the toner may include one type or two types or more of ordinary toner additives such as a charge control agent, a fluidity improving agent, a fixing enhancer, and a conductivity agent.

The toner may be manufactured according to commonly known methods such as a pulverization method in which substances such as a coloring agent and a release agent are melted and kneaded with a binder resin then pulverized, a suspension polymerization method in which, after substances such as a coloring agent, a release agent, and a monomer of a binder resin are evenly dispersed, the monomer of the binder resin is polymerized, or an emulsification/agglomeration method in which substances such as binder resin particles, a coloring agent, and a release agent are caused to agglomerate by an agglomeration agent, then fine particles of the thus-obtained agglutinate are heated.

Although there is no particular limitation to the volume mean particle size of the toner, it is preferably 2 to 7 μm. Furthermore, in a case where the volume mean particle size of the toner is moderately small in this manner, there is a high coverage with respect to the recording medium, and therefore high image quality can be achieved with a low amount of adherence, and the amount of toner consumed can be reduced.

When the volume mean particle size of the toner is less than 2 μm, the fluidity of the toner is reduced and the supply, churning, and charging of the toner is insufficient during development operations such that insufficient toner amounts or increases in opposite polarity toner and the like may occur, and there is a risk that high image quality images may not be obtained. On the other hand, when the volume mean particle size exceeds 7 μm, there are more toner particles of a large particle size, which are difficult to be softened through to a central area, and therefore the fixing qualities of the image to the recording paper 8 are reduced and color production of the image is worsened, and in the case of fixing to an OHP in particular, the image becomes darker.

Other than their coloring agents, the toner of each color used in the present embodiment has the same configuration as shown below. The toner for example has a glass transition point of 60° C., a softening point of 120° C., and a volume mean particle size of 6 μm, and is a negatively charged toner having insulation properties and nonmagnetic properties. A toner amount of 5 g/m$^2$ is necessary to obtain using this toner an image having a reflected density value of 1.4 measured by of an X-Rite produced 310. This toner includes polyester having a glass transition point of 60° C. and a softening point of 120° C. as the binder resin, a low molecular polyethylene wax having a glass transition point of 50° C. and a softening point of 70° C. as the release agent, and a pigment of each color as the coloring agent, wherein the amount of wax contained is 7% by weight of the total toner amount, the ratio of pigment contained is 12% by weight of the total toner amount, and the remainder is the polyester of the binder resin. The low molecular polyethylene wax contained in the toner is a wax having a lower glass transition point and softening point than the polyester of the binder resin.

The developers 16*y*, 16*m*, 16*c*, and 16*b* may also include a carrier in addition to toner. Particles having magnetic properties may be used as the carrier. Specific examples of particles having magnetic properties include for example metals such as iron, ferrite, and magnetite, as well as alloys of these metals with a metal such as aluminum or lead. Of these, ferrite is preferable.

Furthermore, carriers such as a resin covered carrier in which a resin covers the particles having magnetic properties, or a resin diffused-type carrier in which the particles having magnetic properties are diffused in a resin may be used as the carrier. Although there is no particular limitation to the resin for covering the particles having magnetic properties, examples that can be set forth include olefin-based resins, styrene-based resins, styrene/acrylic-based resins, silicone-based resins, ester-based resins, and polymer-based resins containing fluorine. Furthermore, although there is no particular limitation to the resin used in resin diffused-type carrier, examples that can be set forth include styrene-acrylic resins, polyester resins, fluorine-based resins, and phenol resins.

The shape of the carrier is preferably spherical or flat shaped. Furthermore, although there is no particular limitation to the volume mean particle size of the carrier, in consideration of enabling high image quality, it is preferably not less than 30 μm and not greater than 50 μm. Further still, the resistivity of the carrier is preferably not less than $10^8$ Ωcm and even more preferably not less than $10^{12}$ Ωcm. The resistivity value of the carrier is a value that can be obtained by inserting and tapping carrier into a container having a cross-sectional area of 0.50 $cm^2$, then applying a load of 1 $kg/cm^2$ to the particles packed in the container, and reading an electric current value when a voltage that produces an electric field of 1,000 V/cm is applied between the load and a bottom surface electrode. When the resistivity is low, a charge is injected to the carrier when a bias voltage has been applied to the development sleeves 17*y*, 17*m*, 17*c*, and 17*d* such that it becomes easier for the carrier particles to adhere to the photosensitive drum. Furthermore, the breakdown of the bias voltage becomes easier.

The magnetization strength (maximum magnetization) of the carrier is preferably 10 emu/g to 60 emu/g, and even more preferably 15 emu/g to 40 emu/g. Although the magnetization strength also depends on the magnetic flux density of the development sleeves 17*y*, 17*m*, 17*c*, and 17*d*, a magnetic constraining force does not work when the magnetization strength is less than 10 emu/g under conditions of ordinary magnetic flux density of the development sleeves 17*y*, 17*m*, 17*c*, and 17*d*, and there is a risk that this will cause carrier scattering. Also, when the magnetization strength exceeds 60 emu/g, in noncontact development in which the chain formation of carrier becomes too high, it becomes difficult to maintain a noncontact state with the photosensitive drum, which is the latent image carrier. Furthermore, for contact development, there is a risk that sweep marks tend to occur in the toner image.

There is no particular limitation to the usage ratio of toner and carrier in the developers 16*y*, 16*m*, 16*c*, and 16*b*, and this may be selected as appropriate in response to the type of toner and carrier.

With the image forming unit 10*y*, a voltage of −1,200 V for example is applied to the charging roller 12*y* by an unshown power source while the photosensitive drum 11*y* is rotationally driven around its axis, then by causing a discharge, the surface of the photosensitive drum 11*y* is charged to −600 V for example. Next, the laser light 13*y* corresponding to yellow color image information is irradiated from the optical scanning unit 13 onto the surface of the photosensitive drum 11*y*, which is in a charged state, to form an electrostatic latent image having an exposure electric potential of −70 V corresponding to the yellow color image information.

Following this, the surface of the photosensitive drum 11*y* and the yellow color developer carried on the surface of the development sleeve 17*y* are brought in close vicinity to each other. A direct current voltage of −450 V is applied to the development sleeve 17*y* as a development electric potential, and yellow color toner adheres to the electrostatic latent image due to the electric potential difference between the development sleeve 17*y* and the photosensitive drum 11*y* such that a yellow color toner image is formed on the surface of the photosensitive drum 11*y*. As is described later, the yellow color toner image undergoes intermediate transfer to the intermediate transfer belt 21, which presses against the surface of the photosensitive drum 11*y* and is driven in the direction of the arrow 27. Yellow color toner that is residual on the surface of the photosensitive drum 11*y* is removed and collected by the drum cleaner 15*y*. After this, the yellow color toner image formation operation is repetitively executed in a same manner.

Next, description is given regarding the intermediate transfer portion 3. As shown in FIG. 1, the intermediate transfer portion 3 is configured including the intermediate transfer belt 21, intermediate transfer rollers 22*y*, 22*m*, 22*c*, and 22*b*, support rollers 23, 24, and 25, and a belt cleaner 26. The intermediate transfer belt 21 is an image carrier in a form of endless belt that spans in a tensioned state between the support rollers 23, 24, and 25 to form a loop shaped movement route, and is rotationally driven at a peripheral velocity substantially equivalent to the photosensitive drums 11*y*, 11*m*, 11*c*, and 11*b* so as to move in the direction of the arrow 27, that is, such that its image carrier surface facing the photosensitive drums 11*y*, 11*m*, 11*c*, and 11*b* moves from the photosensitive drum 11*y* toward the photosensitive drum 11*b*.

A polyimide film having a thickness of 100 μm for example may be used for the intermediate transfer belt 21. The material of the intermediate transfer belt 21 is not limited to only polyimide, and a film constituted by synthetic resins such as polycarbonate, polyamide, polyester, and polypropylene, or various types of rubber or the like may be used. An electrical conducting material such as furnace black, thermal black, channel black, or graphite carbon is added to the film constituted by the synthetic resin or various types of rubber so as to adjust the electrical resistance value of the intermediate transfer belt 21. Furthermore, a covering layer constituted by a fluorine resin composition or a fluorocarbon rubber or the like, which has low adhesion to toner, may be provided for the intermediate transfer belt 21. Constituent substances of the covering layer that can be set forth include PTFE (polytetrafluoroethylene) and PFA (a copolymer of PTFE and perfluoro alkyl vinyl ether) for example. A conductive material may be added to the covering layer.

The image carrier surface of the intermediate transfer belt 21 presses against the photosensitive drums 11*y*, 11*m*, 11*c*, and 11*b* in this order from an upstream side in the rotational drive direction of the intermediate transfer belt 21. The positions where the intermediate transfer belt 21 press against the photosensitive drums 11*y*, 11*m*, 11*c*, and 11*b* are intermediate transfer positions of the toner image of each color. The intermediate transfer rollers 22*y*, 22*m*, 22*c*, and 22*b* are roller shaped members that are arranged so as to be in opposition to the photosensitive drums 11*y*, 11*m*, 11*c*, and 11*b* respectively through the intermediate transfer belt 21, press against the opposite surface of the intermediate transfer belt 21 from image carrier surface, and are arranged so as to be capable of being rotationally driven around their axes by an unshown drive means.

For example, roller shaped members including a metal shaft structure and a conductive layer that covers a surface of the metal shaft structure may be used as the intermediate transfer rollers 22*y*, 22*m*, 22*c*, and 22*b*. For example, the metal shaft structures are formed using a metal such as stainless steel. Although there is no particular limitation to the diameter of the metal shaft structures, it is preferably 8 to 10 mm. The conductive layer is formed using a conductive elastic material or the like. An ordinary material used in this field may be used for the conductive elastic material, examples of which include an ethylene-propylene rubber (hereinafter referred to as EPDM), an EPDM foam, and a urethane foam or the like including a conductive agent such as carbon black. A high voltage is applied uniformly to the intermediate transfer belt 21 by the conductive layer.

An intermediate transfer bias of an opposite polarity to the charge polarity of the toner is applied through constant voltage control to the intermediate transfer rollers 22*y*, 22*m*, 22*c*, and 22*b* so that the toner images to be formed on the surface of the photosensitive drums 11*y*, 11*m*, 11*c*, and 11*b* are transferred to the intermediate transfer belt 21. In this way, the toner images of the colors yellow, magenta, cyan, and black formed on the photosensitive drums 11*y*, 11*m*, 11*c*, and 11*b* are successively superimposed and transferred onto the image carrier surface of the intermediate transfer belt 21 to form a multicolor toner image. Note however that in a case where image information of only some of the colors of yellow, magenta, cyan, and black is inputted, toner images are formed by only the image unit(s) 10 corresponding to the color(s) of the inputted image information of the image forming units 10*y*, 10*m*, 10*c*, and 10*b*.

Of the support rollers 23, 24, and 25, the support rollers 23 and 25 are arranged so as to be capable of being rotationally driven around their axes by an unshown drive means, and are rotationally driven in the direction of the arrow 27 spanning the intermediate transfer belt 21 in a tensioned state. For example, aluminum cylinder structures (pipe shaped rollers) having a diameter of 30 mm and a wall thickness of 1 mm may be used for the support rollers 23 and 25. Of these rollers, the support roller 24 forms a secondary transfer nip portion by pressing against a secondary transfer roller 28, which is described later, through the intermediate transfer belt 21, and is electrically grounded. The support roller 24 has a function of enabling the intermediate transfer belt 21 to span the rollers in a tensioned state, and also has a function of enabling secondary transfer of the toner image on the intermediate transfer belt 21 to the recording paper 8.

The belt cleaner 26 is a member for removing toner that is residual on the image carrier surface after the toner image on the image carrier surface of the intermediate transfer belt 21 is transferred to the recording paper 8 by the secondary transfer portion 4, which is described later, and is arranged so as to be in opposition to the support roller 25 through the intermediate transfer belt 21.

With the intermediate transfer portion 3, the toner images formed on the photosensitive drums 11*y*, 11*m*, 11*c*, and 11*b* are superimposed and undergo intermediate transfer at a predetermined position of the image carrier surface of the intermediate transfer belt 21 due to a high voltage of an opposite polarity to the charge polarity of the toner being uniformly applied to the intermediate transfer rollers 22*y*, 22*m*, 22*c*, and 22*b*, thereby forming a toner image. As is described later, this toner image undergoes secondary transfer to the recording paper 8 at the secondary transfer nip portion. Toner that is residual on the image carrier surface of the intermediate transfer belt 21 after secondary transfer and paper dust or the like are removed by the belt cleaner 26, and a toner image is again transferred to the image carrier surface.

Next, description is given regarding the secondary transfer portion 4. As shown in FIG. 1, the secondary transfer portion 4 includes the support roller 24 and the secondary transfer roller 28. The secondary transfer roller 28 is a roller shaped member that presses against the support roller 24 through the intermediate transfer belt 21 and is arranged so as to be capable of being rotationally driven around its axis. For example, the secondary transfer roller 28 includes a metal shaft structure and a conductive layer that covers a surface of the metal shaft structure. For example, the metal shaft structure is formed using a metal such as stainless steel. The conductive layer is formed using a conductive elastic material or the like. An ordinary material used in this field may be used for the conductive elastic material, examples of which include an EPDM, an EPDM foam, and a urethane foam or the like including a conductive material such as carbon black. An unshown power source is connected to the secondary transfer roller 28 and it is uniformly applied with a high voltage of an opposite polarity to the charge polarity of the toner particles. A pressing portion between the support roller 24, the intermediate transfer belt 21, and the secondary transfer roller 28 is the secondary transfer nip portion.

With the secondary transfer portion 4, a recording paper 8 supplied from the above-mentioned recording medium supply portion 5 is transported to the secondary transfer nip portion in synchronization with the toner image on the intermediate transfer belt 21 being transported to the secondary transfer nip portion. Then, the toner image and the recording paper 8 are superimposed at the secondary transfer nip portion, and an image formed from toner undergoes secondary transfer to the recording paper 8 due to a high voltage of an opposite polarity to the charge polarity of the toner being uniformly applied to the secondary transfer roller 28. Then, the recording paper 8 onto which the toner image has been carried is transported to the fixing portion 6.

Next, description is given regarding the fixing portion 6, which is provided with a feature of the present invention. As shown in FIG. 4, the fixing portion 6 includes the fixing roller 50, the pressure roller 60, and the external heating member 70.

The fixing roller 50 is a roller shaped member that is rotatably supported by an unshown support means and is rotated at a predetermined velocity in a direction of the arrow 56 by an unshown drive means. The fixing roller 50 thermally melts the toner that constitutes the toner image carried on the recording paper 8 to fix the toner to the recording paper 8. In the present embodiment, a roller shaped member including a core 51, an elastic structure layer 52, and a surface layer 53 is used as the fixing roller 50. A metal having a high thermal conduction rate may be used as a metal that forms the core 51, examples of which include aluminum and iron and the like. Although cylindrical and columnar shapes can be set forth as a shape of the core 51, a cylindrical shape, which has a small amount of heat discharge from the core 51, is preferable. Although there is no limitation to the material that constitutes the elastic structure layer 52 as long as it has a rubber elasticity, a material having even superior heat resistance is preferable. Specific examples of such materials include silicone rubber, fluorine rubber, and fluorosilicone rubber. Of these, silicone rubber is preferable, which has particularly excellent rubber elasticity. There is no particular limitation to the material that constitutes the surface layer 53 as long as it has excellent heat resistance and durability, as well as poor adhesion with toner, but examples include PFA (a copolymer of tetrafluoroethylene and perfluoroalkyl vinyl ether) and PTFE (polytetrafluoroethylene) or other fluorine-based resin materials and, fluorine rubber. In the present embodiment, the surface layer 53 is a PFA layer having a thickness of approximately 40 μm. A heat source 54 is provided inside the fixing roller 50. This is for shortening the startup time from switching on the power to the image forming apparatus 1 until image forming is possible, and for preventing drops in the surface temperature of the fixing roller 50 caused by heat transitioning to the recording paper 8 during fixing of the toner image. In the present embodiment, a halogen lamp is used for the heat source 54.

The pressure roller 60 is a roller shaped member arranged rotatably in a state pressing against the fixing roller 50 due to an unshown pressure mechanism at a downstream side in the rotation direction of the fixing roller 50 from a lowest point in the vertical direction of the fixing roller 50. The pressing portion between the fixing roller 50 and the pressure roller 60 is the fixing nip portion 55. The pressure roller 60 idly rotates with the rotation of the fixing roller 50. The pressure roller 60 facilitates fixing of the toner image to the recording paper 8 by pressing the toner, which is in a melted state, against the recording paper 8 during thermal fixing of the toner image to the recording paper 8 by the fixing roller 50. In the present embodiment, a roller shaped member having a diameter of 40 mm and including a core 61, an elastic structure layer 62, and a surface layer 63 is used as the pressure roller 60. The same metals or materials that form the core 51, the elastic structure layer 52, and the surface layer 53 of the fixing roller 50 can be used as the materials that form the core 61, the elastic structure layer 62, and the surface layer 63. Furthermore, the shape of the core 61 is equivalent to the fixing roller 50. A heat source 64 is provided inside the pressure roller 60. This is for shortening the startup time from switching on the power to the image forming apparatus 1 until image forming is possible, and for preventing sudden drops in the surface temperature of the pressure roller 60 caused by heat transitioning to the recording paper 8 during fixing of the toner image. In the present embodiment, a halogen lamp is used for the heat source 64.

The external heating member 70 includes the endless belt 71, the two support rollers of the first support roller 72 and the second support roller 73, temperature detection members (hereinafter referred to as thermistors) 76 and 78, and a thermostat 77. The endless belt 71 is an endless belt shaped member that spans the first support roller 72 and the second support roller 73 in a tensioned state to form a loop shaped movement route. Furthermore, the endless belt 71 is arranged contacting the fixing roller 50 in a region having a band shape, the region having a length in the peripheral direction of the fixing roller 50 between a pressing point between the first support roller 72 and the fixing roller 50 and a pressing point between the second support roller 73 and the fixing roller 50, and extending over a longitudinal direction of the fixing roller 50. Furthermore, the endless belt 71 idly rotates in the direction of the arrow 79 due to rotational drive in the arrow 56 direction of the fixing roller 50. Although there is no particular limitation to the material of the endless belt 71 as long as it is a material having superior heat resistance and durability, examples include a belt made from polyimide, and a nickel electroformed belt or the like. A fluorine resin layer such as PFA or PTFE or the like may be formed on a surface of the endless belt 71. In the present embodiment, an endless belt having a thickness of 100 μm formed in a cylindrical shape having a diameter of 31 mm is used.

The first support roller 72 and the second support roller 73 are roller shaped members that are rotatably supported and are arranged so as to press against the surface of the fixing roller 50 through the endless belt 71 due to an unshown pressure means. The first support roller 72 and the second support roller 73 idly rotate with the rotation in the direction of the arrow 79 of the endless belt 71. Metal rollers constituted by a metal having a high thermal conduction rate such as aluminum or iron or the like may be used for the first support roller 72 and the second support roller 73. A fluorine resin layer may be formed on a surface of the metal rollers as necessary. The first support roller 72 and the second support roller 73 are provided therein with heat sources 74 and 75. These heat the endless belt 71 and consequently heat the fixing roller 50. The heat sources 74 and 75 are connected to a power source, and power is supplied for causing the heat sources 74 and 75 to generate heat. Ordinary heat sources may be used for the heat sources 74 and 75. In the present embodiment, halogen lamps are used for the heat sources 74 and 75. It should be noted that the first support roller 72 and the second support roller 73 are arranged such that their axes are parallel on the fixing roller 50 and are set apart having an interval therebetween. The thermistor 76 is arranged in close vicinity to the endless belt 71 at a position facing the second support roller 73 through the endless belt 71, and detects a second temperature, which is a temperature of an area of the endless belt 71 where the endless belt 71 contacts the second support roller 73.

Also, the thermistor 78 is arranged in close vicinity to the endless belt 71 at a position facing the first support roller 72 through the endless belt 71, and detects a first temperature, which is a temperature of an area of the endless belt 71 where the endless belt 71 contacts the first support roller 72.

Furthermore, the thermostat 77 is arranged so as to face the second support roller 73 through the endless belt 71 and is in close vicinity to the endless belt 71 at a position on a downstream side in the rotation direction of the endless belt 71 from the thermistor 76, and detects abnormal temperature rises of the endless belt 71.

As described above, the fixing portion 6 is controlled by the fixing portion control circuit 6*a* of the control unit 9. That is, the fixing mechanism including the fixing roller 50, the pressure roller 60, and the external heating member 70 is controlled by the fixing portion control circuit 6*a*. Upon receiving input of an image forming instruction, the CPU 9*a* sends control signals to the power sources that supply power to the heat sources 54, 64, 74, and 75 arranged inside the fixing roller 50, the pressure roller 60, and the first and second support rollers 72 and 73. The image forming instruction is inputted from the operation portion 7*b* arranged on the upper surface of the image forming apparatus 1 or from an external device such as a computer connected to the image forming apparatus 1 via a LAN. Having received a control signal, the power sources supply power to start up the heat sources 54, 64, 74, and 75. The heat sources 54, 64, 74, and 75 perform heating such that the surfaces of the fixing roller 50, the pressure roller 60, and the endless belt 71 reach their respectively set temperatures. When unshown temperature detection sensors arranged near the fixing roller 50 and the pressure roller 60 detect that the set temperatures have been reached and detection results thereof have been inputted to the CPU 9*a*, the CPU 9*a* sends a control signal to the unshown drive means that rotationally drives the fixing roller 50 such that the fixing roller 50 is rotationally driven in the direction of the arrow 56. Accompanying this, the pressure roller 60 and the endless belt 71 are idly rotated. In this state, the recording paper 8, which carries an unfixed toner image, is transported from the secondary transfer portion 4 to the fixing nip portion 55. When the recording paper 8 passes through the fixing nip portion 55, the toner that constitutes the toner image is subjected to heat and pressure and becomes fixed to the recording paper 8 to form an image.

In the above-described fixing portion 6, the detection results of the thermostat 77 are inputted to the CPU 9*a* via the fixing portion control circuit 6*a* of the control unit 9. The CPU 9*a* stops the supply of power from the power sources connected to the heat sources 74 and 75 in response to the detection results of the thermostat 77.

Furthermore, temperature detection results of the thermistor 76 and the thermistor 78, namely the first temperature, which is the temperature of an area of the endless belt 71 where the endless belt 71 contacts the first support roller 72, and the second temperature, which is the temperature of an area of the endless belt 71 where the endless belt 71 contacts the second support roller 73, are inputted to the CPU 9*a* of the control unit 9 via the fixing portion control circuit 6*a* of the control unit 9.

Then, the CPU 9*a* compares the thus-measured first temperature and the second temperature. In comparing the first temperature and the second temperature, in a case where the lower of either of these temperatures is a prescribed value or lower, it is determined that the second support roller is undergoing a rotation stoppage when the lower temperature is the first temperature, and it is determined that the first support roller is undergoing a rotation stoppage when the lower temperature is the second temperature. That is, a rotation stoppage of one of the support rollers is detected, which is a rotation stoppage of one of the first support roller 72 and the second support roller 73. It should be noted that the above-mentioned prescribed value can be obtained from test results using statistical processing as described earlier.

When the CPU 9*a* detects a rotation stoppage of one of the support rollers, the control unit 9 carries out the following processing. First, when a rotation stoppage of one of the support rollers is detected, whether it is the first support roller or the second support roller that is undergoing a rotation stoppage is stored in the memory 9*c* of the control unit 9.

By doing this, maintenance personnel or the like of the image forming apparatus 1 can carry out measures against rotation stoppages of one of the support rollers by confirming information stored in the above-mentioned means for storing information of rotation stoppage of one of the support rollers.

Furthermore, when the CPU 9*a* detects a rotation stoppage of one of the support rollers, the control unit 9 displays warning information as to whether it is the first support roller or the second support roller that is undergoing a rotation stoppage on the display portion 7*a* of the image forming apparatus 1. By doing this, an operator or the like of the image forming apparatus 1 can be prompted to urgently carry out measures against rotation stoppages of one of the support rollers.

Furthermore, as described above, the first support roller 72 and the second support roller 73 are provided therein with the heat sources 74 and 75. The heat source 74 and the heat source 75 are connected to a power source, and supply of the power source is carried out by the fixing portion control circuit 6*a* of the control unit 9.

Accordingly, when the CPU 9*a* detects a rotation stoppage of one of the support rollers, the control unit 9 carries out control of reducing the power to be supplied to the heat source 74 or the heat source 75 provided in the first support roller 72 or the second support roller 73 that is undergoing a rotation stoppage. The power control can be carried out by waveform control or the like using a thyristor for example. By doing this, it is possible to prevent abnormal temperature rises of the first support roller 72, the second support roller 73, and the endless belt 71.

Furthermore, in the above-described image forming apparatus 1, after a fixing command has been received and the hot roller 50 is rotated, and the recording paper 8 is caused to pass through the nip portion to complete the fixing operation, the control unit 9 stops rotation of the fixing roller 50 after the power supplied to the heat source 74 and the heat source 75 provided in the first support roller 72 and the second support roller 73 is stopped and post-rotation has been carried out in which the fixing roller 50 is caused to rotate for a prescribed time.

Accordingly, when the CPU 9*a* detects a rotation stoppage of one of the support rollers, the control unit 9 sets the time of the above-mentioned post-rotation longer than the prescribed time. By doing this, the heat of the first support roller 72, the second support roller 73, and the endless belt 71 can be sufficiently dispersed, and it is possible to prevent abnormal temperature rises of the first support roller 72, the second support roller 73, and the endless belt 71.

With the fixing portion 6 provided in the image forming apparatus 1, it is possible to detect a rotation stoppage of one of the support rollers of either the first support roller 72 or the second support roller 73 by comparing the first temperature, which is the temperature of an area of the endless belt 71 where the endless belt 71 contacts the first support roller 72, and the second temperature, which is the temperature of an area of the endless belt 71 where the endless belt 71 contacts the second support roller 73.

For this reason, when a rotation stoppage of one of the support rollers has been detected in the above-mentioned fixing portion 6, it is possible to carry out a measure against the rotation stoppage of one of the support rollers, and it is possible to prevent occurrences of problems that accompany a rotation stoppage of one of the support rollers.

In the fixing portion 6 provided in the image forming apparatus 1, a temperature of an area of the endless belt 71 where the endless belt 71 contacts the first support roller 72 is used as the first temperature, and a temperature of an area of the endless belt 71 where the endless belt 71 contacts the second support roller 73 is used as the second temperature.

However, it is also possible to use a temperature of an area of the first support roller 72 where the endless belt 71 contacts the first support roller 72 as the first temperature, and it is possible to use a temperature of an area of the second support roller 73 where the endless belt 71 contacts the second support roller 73 as the second temperature.

Furthermore, with respect to the fixing portion 6 provided in the above-described image forming apparatus 1, some of the configuration of the fixing portion 6 may be modified as in a following manner. Namely, the first support roller 72 and the second support roller 73 are provided with a support roller pressure adjustment means that adjusts the pressure of the first support roller and the pressure of the second support roller through the heating belt onto the fixing roller 50 under a condition of contacting the fixing roller 50 through the endless belt 71.

Then, when the CPU 9*a* of the control unit 9 detects a rotation stoppage of one of the support rollers, the control unit 9 acts such that the pressure of the support roller of either the first support roller 72 or the second support roller 73 that is undergoing a rotation stoppage is adjusted by the support roller pressure adjustment means.

By doing this, the heat of the first support roller 72, the second support roller 73, or the endless belt 71 can be sufficiently dispersed, and it is possible to prevent abnormal temperature rises in the first support roller 72, the second support roller 73, or the endless belt 71.

Furthermore, in the fixing portion 6 of the above-described image forming apparatus 1, that is, in the fixing apparatus according to the present embodiment, the contact surface area or the contact pressure of the endless belt 71 to the fixing roller 50 may be varied by using a contact adjustment mechanism that moves apart or brings closer together either the first support roller, the second support roller, or both with respect to the fixing roller 50 when the CPU 9*a* of the control unit 9 has detected a rotation stoppage of one of the support rollers.

Figure 6:
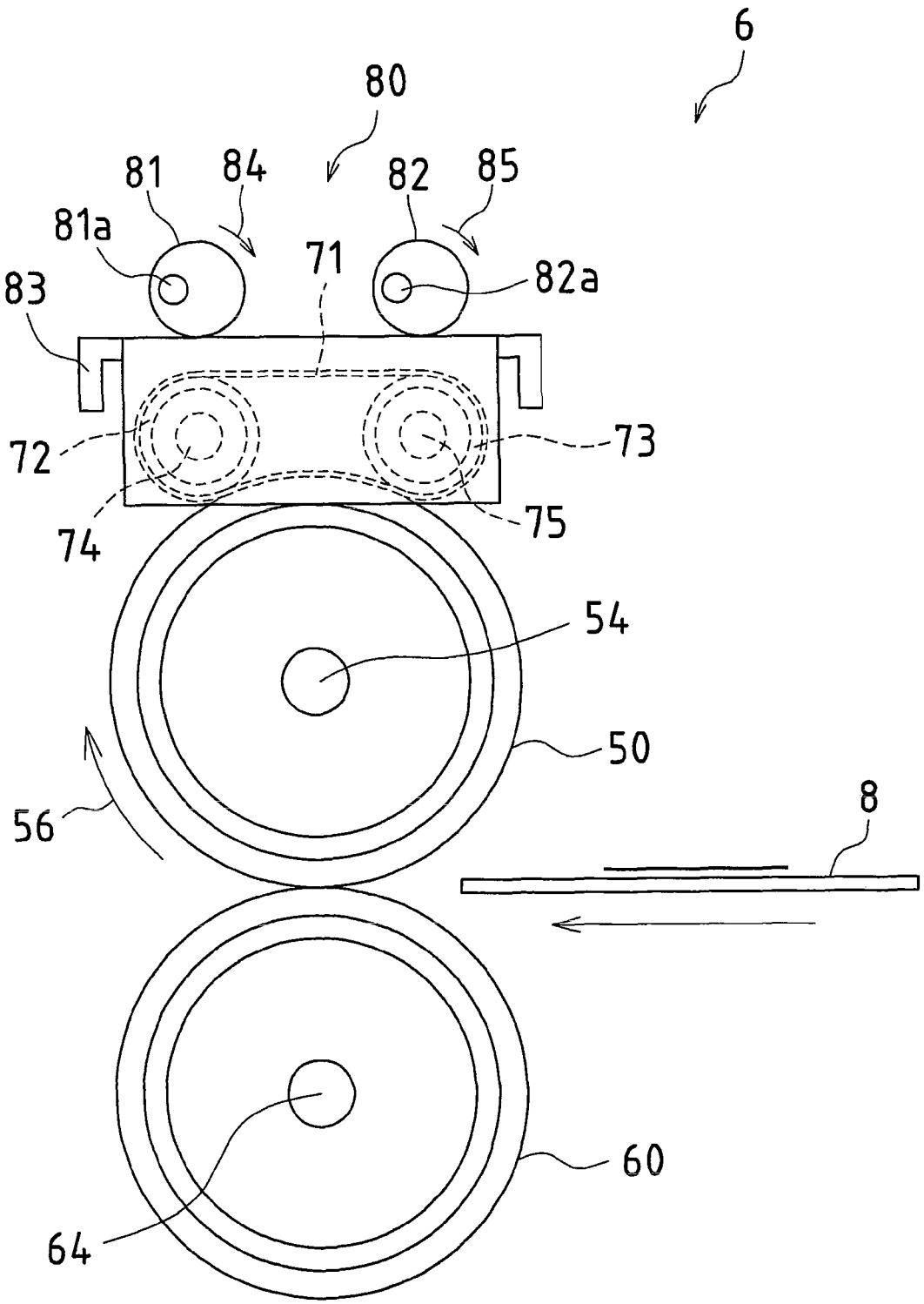
FIG. 6 is a schematic view showing a configuration of a fixing apparatus according to another embodiment of the present invention.
Figure 7:
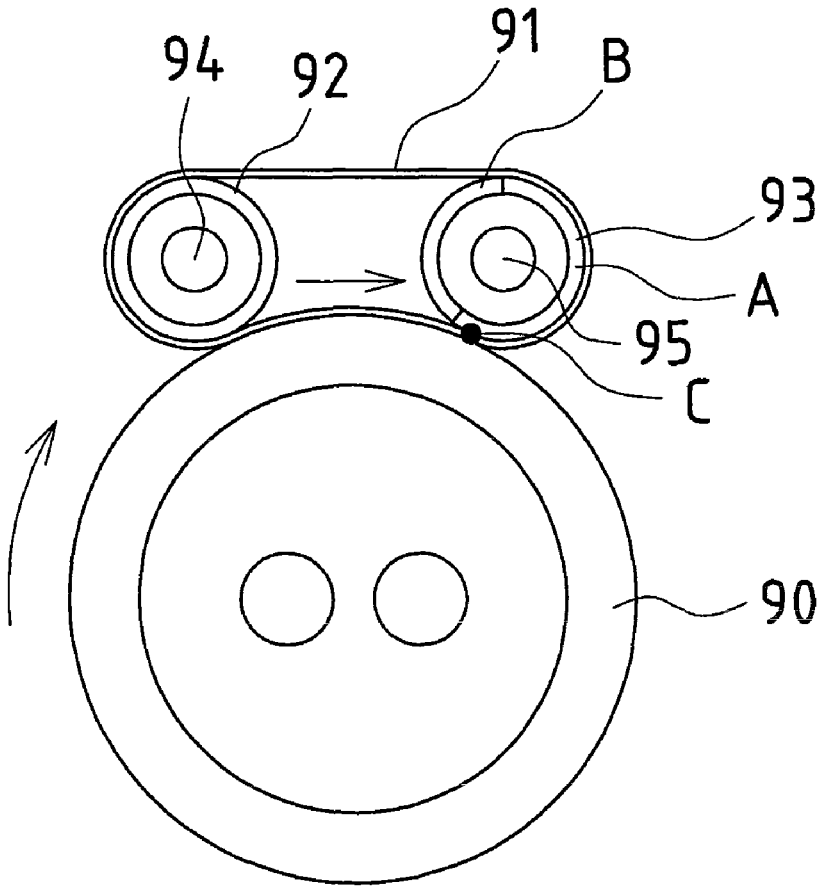
FIG.7 Prior Art
FIG. 7 is a schematic view showing a configuration of a fixing apparatus according to a conventional example of a belt-type external heating fixing system.

FIG. 6 is a schematic view showing a configuration of the fixing apparatus according to the present embodiment in which the contact adjustment mechanism 80 is installed. In FIG. 6, the contact adjustment mechanism 80 is constituted by an external heating frame 83, which internally supports the first support roller 72 and the second support roller 73 and whose upper external surface is flat shaped, and a contact condition varying roller 81 and a contact condition varying roller 82 that are provided with eccentric axes respectively arranged in contact with the first support roller 72 side and the second support roller 73 side of the upper external surface of the external heating frame 83.

In the fixing portion 6 provided with the above-described contact adjustment mechanism 80, either the first support roller 72, the second support roller 73, or both can be independently moved apart from or brought closer to the fixing roller 50 and either the contact pressure, the contact surface area, or both thereof with respect to the fixing roller 50 can be altered independently by independently driving the contact condition varying roller 81 in a rotation direction 84 or the contact condition varying roller 82 in a rotation direction 85.

In the above-mentioned contact adjustment mechanism 80, the contact condition varying roller 81 and the contact condition varying roller 82 are driven by pulse motors or the like controlled by the control unit 9, and control of the contact condition varying roller 81 and the contact condition varying roller 82 is carried out by controlling a rotation angle of these pulse motors or the like when the CPU 9*a* of the control unit 9 has detected a rotation stoppage of one of the support rollers.

Thus, by using the contact adjustment mechanism 80 or the like, rotation for the first support roller 72 or the second support roller 73 undergoing a rotation stoppage can be automatically prompted by performing a measure such as bringing the first support roller 72 or the second support roller 73, which is undergoing a rotation stoppage, closer to the fixing roller 50.

In the fixing portion 6 provided in the above-described image forming apparatus 1, that is, in the fixing apparatus according to the present embodiment, two support rollers are used, namely the first support roller 72 and the second support roller 73, as the support rollers that suspend and support the endless belt 71. However, the support rollers that suspend and support the endless belt 71 are not limited to these, and it is also possible to use three or more support rollers. In this case, by carrying out the same measures as described above on two of the support rollers of the three or more support rollers, equivalent effects can be obtained as those described above.

The present invention can be embodied and practiced in other different forms without departing from the spirit and essential characteristics thereof. Therefore, the above-described working examples are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A fixing apparatus, in which a recording material is caused to pass through a nip portion formed by contact between a rotating hot roller and a rotating pressure roller such that an unfixed image on the recording material becomes fixed, comprising:

a heating belt that contacts and rotates with the hot roller and that conducts heat to the hot roller, a first support roller and a second support roller that are provided with a heat source, are heated by the heat source, support the rotating heating belt suspended therebetween, and rotate to conduct heat to the heating belt, a first temperature detection means that detects a first temperature, which is a temperature of an area of the first support roller where it contacts the heating belt or an area of the heating belt where it contacts the first support roller, a second temperature detection means that detects a second temperature, which is a temperature of an area of the second support roller where it contacts the heating belt or an area of the heating belt where it contacts the second support roller, and a means for detecting rotation stoppage of one of the support rollers that detects a rotation stoppage of one of the support rollers, which is a rotation stoppage of one of the first support roller and the second support roller, by comparing the first temperature and the second temperature.

2. The fixing apparatus according to claim 1, wherein the first support roller and the second support roller contact the hot roller through the heating belt.

3. An image forming apparatus provided with the fixing apparatus according to claim 2.

4. The fixing apparatus according to claim 1, wherein, as a technique for detecting rotation stoppage of one of the support rollers, the means for detecting rotation stoppage of one of the support rollers, in a case where a temperature of one of the first temperature and the second temperature is lower than a temperature of the other and the lower temperature is not greater than a predetermined value, detects that the second support roller is undergoing a rotation stoppage when the lower temperature is the first temperature, and detects that the first support roller is undergoing a rotation stoppage when the lower temperature is the second temperature.

5. The fixing apparatus according to claim 4, comprising a means for storing information of rotation stoppage of one of the support rollers, wherein the means for storing information of rotation stoppage of one of the support rollers stores which of the first support roller and the second support roller is undergoing a rotation stoppage when the means for detecting rotation stoppage of one of the support rollers detects a rotation stoppage of one of the support rollers.

6. An image foiniing apparatus provided with the fixing apparatus according to claim 5.

7. The fixing apparatus according to claim 4, comprising a means for outputting warning information of rotation stoppage of one of the support rollers, wherein the means for outputting warning information of rotation stoppage of one of the support rollers outputs warning information of which of the first support roller and the second support roller is undergoing a rotation stoppage when the means for detecting rotation stoppage of one of the support rollers detects a rotation stoppage of one of the support rollers.

8. The fixing apparatus according to claim 4, comprising a contact adjustment means that carries out contact adjustment in which either the first support roller, the second support roller, or both are moved apart from or brought closer to the hot roller, wherein the contact adjustment means carries out the contact adjustment when the means for detecting rotation stoppage of one of the support rollers detects a rotation stoppage of one of the support rollers.

9. The fixing apparatus according to claim 4, comprising a contact pressure adjustment means that adjusts a contact pressure of either the first support roller, the second support roller, or both to the hot roller, wherein the contact pressure adjustment means adjusts the contact pressure when the means for detecting rotation stoppage of one of the support rollers detects a rotation stoppage of one of the support rollers.

10. The fixing apparatus according to claim 4, comprising a support roller heat source power supply means that supplies power to the heat source provided in the first support roller and the second support roller, wherein the support roller heat source power supply means reduces the power supplied to the heat source provided in either of the first support roller or the second support roller that is undergoing a rotation stoppage when the means for detecting rotation stoppage of one of the support rollers detects a rotation stoppage of one of the support rollers.

11. The fixing apparatus according to claim 4, comprising:

a support roller heat source power supply means that supplies power to the heat source provided in the first support roller and the second support roller, and a hot roller control means that, after a fixing command has been received and the hot roller is rotated, and the recording material is caused to pass through the nip portion to complete a fixing operation, stops rotation of the hot roller after the support roller heat source power supply means stops a power supply and post-rotation has been carried out in which the hot roller is caused to rotate for a prescribed time, wherein the hot roller control means sets a time of the post-rotation longer than the prescribed time when the means for detecting rotation stoppage of one of the support rollers detects a rotation stoppage of one of the support rollers.

12. An image forming apparatus provided with the fixing apparatus according to claim 4.

13. The fixing apparatus according to claim 1, comprising a means for storing information of rotation stoppage of one of the support rollers, wherein the means for storing information of rotation stoppage of one of the support rollers stores which of the first support roller and the second support roller is undergoing a rotation stoppage when the means for detecting rotation stoppage of one of the support rollers detects a rotation stoppage of one of the support rollers.

14. An image forming apparatus provided with the fixing apparatus according to claim 13.

15. The fixing apparatus according to claim 1, comprising a means for outputting warning information of rotation stoppage of one of the support rollers, wherein the means for outputting warning information of rotation stoppage of one of the support rollers outputs warning information of which of the first support roller and the second support roller is undergoing a rotation stoppage when the means for detecting rotation stoppage of one of the support rollers detects a rotation stoppage of one of the support rollers.

16. The fixing apparatus according to claim 1, comprising a contact adjustment means that carries out contact adjustment in which either the first support roller, the second support roller, or both are moved apart from or brought closer to the hot roller, wherein the contact adjustment means carries out the contact adjustment when the means for detecting rotation stoppage of one of the support rollers detects a rotation stoppage of one of the support rollers.

17. The fixing apparatus according to claim 1, comprising a contact pressure adjustment means that adjusts a contact pressure of either the first support roller, the second support roller, or both to the hot roller, wherein the contact pressure adjustment means adjusts the contact pressure when the means for detecting rotation stoppage of one of the support rollers detects a rotation stoppage of one of the support rollers.

18. The fixing apparatus according to claim 1, comprising a support roller heat source power supply means that supplies power to the heat source provided in the first support roller and the second support roller, wherein the support roller heat source power supply means reduces the power supplied to the heat source provided in either of the first support roller or the second support roller that is undergoing a rotation stoppage when the means for detecting rotation stoppage of one of the support rollers detects a rotation stoppage of one of the support rollers.

19. The fixing apparatus according to claim 1, comprising:

a support roller heat source power supply means that supplies power to the heat source provided in the first support roller and the second support roller, and a hot roller control means that, after a fixing command has been received and the hot roller is rotated, and the recording material is caused to pass through the nip portion to complete a fixing operation, stops rotation of the hot roller after the support roller heat source power supply means stops a power supply and post-rotation has been carried out in which the hot roller is caused to rotate for a prescribed time, wherein the hot roller control means sets a time of the post-rotation longer than the prescribed time when the means for detecting rotation stoppage of one of the support rollers detects a rotation stoppage of one of the support rollers.

20. An image forming apparatus provided with the fixing apparatus according to claim 1.

* * * * *